US005669739A

United States Patent [19]

Clarke

[11] Patent Number: 5,669,739

[45] Date of Patent: Sep. 23, 1997

[54] PRESTRESSING OF MINE PROPS

[75] Inventor: Graham Heath Clarke, Randfontein, South Africa

[73] Assignee: HL & H Timber Products (Proprietary) Limited, Johannesburg, South Africa

[21] Appl. No.: 586,049

[22] Filed: Jan. 16, 1996

[30] Foreign Application Priority Data

| | | | |
|---|---|---|---|
| Jul. 5, 1995 | [ZA] | South Africa | 95/5587 |
| Aug. 3, 1995 | [ZA] | South Africa | 95/6489 |

[51] Int. Cl.[6] ..... E21D 15/32

[52] U.S. Cl. ..... 405/289; 405/288; 254/93 HP; 299/11

[58] Field of Search ..... 405/289, 288; 254/93 R, 93 HP; 299/11

[56] References Cited

U.S. PATENT DOCUMENTS

| | | | |
|---|---|---|---|
| 1,752,101 | 3/1930 | Meutsch | 254/93 HP |
| 3,799,504 | 3/1974 | Vaughen | 254/93 HP |
| 4,167,361 | 9/1979 | Petro et al. | 405/289 X |
| 5,178,367 | 1/1993 | Vaughen | 254/93 HP |

FOREIGN PATENT DOCUMENTS

| | | | |
|---|---|---|---|
| 2456706 | 1/1981 | France | 254/93 HP |
| 86/3717 | 5/1986 | South Africa . | |
| 87/8403 | 11/1987 | South Africa . | |
| 87/9109 | 12/1987 | South Africa . | |
| 92/1046 | 2/1992 | South Africa . | |
| 93/3156 | 5/1992 | South Africa . | |
| 93/9581 | 12/1993 | South Africa . | |
| 94/3891 | 6/1994 | South Africa . | |
| 1034537 | 6/1966 | United Kingdom | 405/289 |

*Primary Examiner*—Tamara L. Graysay
*Assistant Examiner*—Frederick L. Lagman
*Attorney, Agent, or Firm*—Panitch Schwarze Jacobs & Nadel, P.C.

[57] ABSTRACT

The mine prop prestressing device (10) has a tube (12), a cup-shaped member (14) inside the tube which has a base (18) and a cylindrical side wall (20) fixed internally to the wall of the tube. A counter-member is also fixed to the tube in opposition to the cup-shaped member, and a valved inlet leads through the wall of the tube for the purpose of introducing a pressurised fluid into the tube between the base of the cup-shaped member and the counter-member. If the fluid is under sufficiently high pressure, the base of the cup-shaped member and the counter member are deformed apart from one another. The counter-member is typically in the form of an identical or similar cup-shaped member (14). The device (10) is a component part of a mine prop which includes a plunger (36, 38) inserted slidably into the tube so as to locate in a cup-shaped member. When pressurised fluid is introduced into the tube, the plunger is driven telescopically out of the tube.

21 Claims, 7 Drawing Sheets

FIG 5
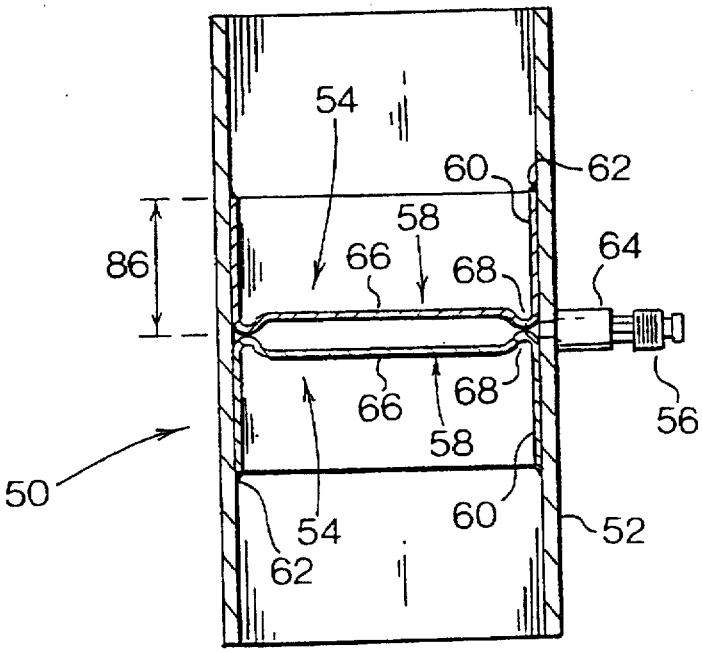
FIG 6
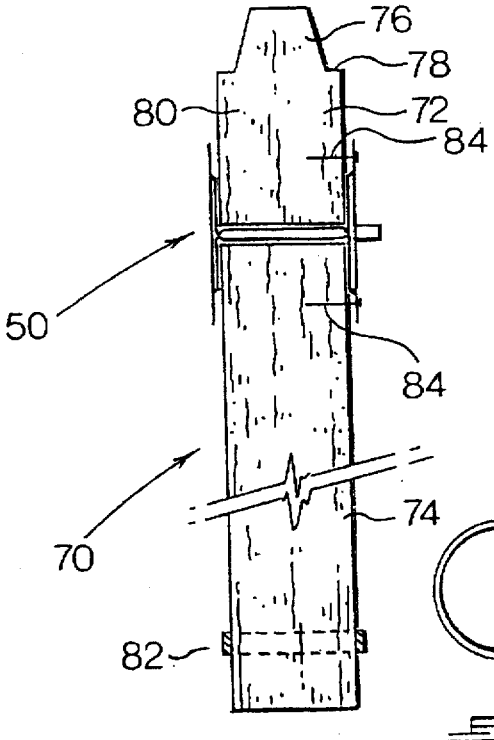
FIG 7
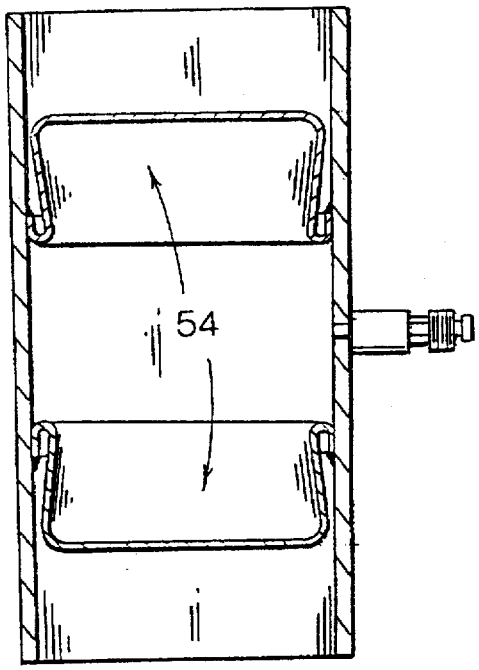
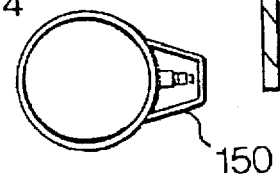
FIG 8

PRESTRESSING OF MINE PROPS

BACKGROUND TO THE INVENTION

THIS invention relates to the prestressing of mine props.

In their use in underground mines, elongate mine props are conventionally trimmed to length and are arranged upright between the hanging wall and footwall of a mine working. Traditional practice has been to wedge each prop in place using a timber wedge driven transversely between the upper end of the prop and the hanging wall. Wedges of this type apply little if any prestressing force to the prop and generally operate only to prevent the prop from toppling over. Even with wedges in place it is possible for a prop to be knocked over by the force of a blast at the mining face. Perhaps even more importantly, the absence of a meaningful prestressing force on the prop means that it is not immediately in a condition to accept loading from the hanging wall.

With a view to providing a greater prestressing force it has also been proposed to use an hydraulic jack placed between an end of the prop and the hanging wall or footwall. The jack is pressurised with hydraulic fluid and expands in the longitudinal direction of the prop, thereby prestressing the prop.

SUMMARY OF THE INVENTION

According to a first aspect of the invention there is provided a mine prop prestressing device comprising a tube, a cup-shaped member inside the tube which has a base and a cylindrical side wall fixed internally to the wall of the tube, a counter-member which is fixed to the tube and which spans across the tube in opposition to and adjacent the base of the cup-shaped member, and a valved inlet leading through the wall of the tube for the purpose of introducing a pressurised fluid into the tube between the base of the cup-shaped member and the counter-member so as to deform the base of the cup-shaped member and the counter member apart from one another.

The arrangement is preferably such that the base of the cup-shaped member is arranged to deform away from the counter-member when a fluid at sufficiently high pressure is introduced into the tube through the valved inlet.

In one version of the invention, the counter-member is in the form of a plate spanning across the tube. In another version of the invention, the counter-member is in the form of a second cup-shaped member having a base and a cylindrical side wall fixed internally to the wall of the tube, the second cup-shaped member being arranged in opposition to the first cup-shaped member with the bases of the cup-shaped members adjacent to one another and with the cylindrical side walls of the cup-shaped members extending in opposite directions from their respective bases. The second cup-shaped member may be identical to the first cup-shaped member, in which case the members may be arranged symmetrically about a central transverse plane bisecting the tube.

Alternatively, the cylindrical side walls of the first and second cup-shaped members may be of different length, with the members arranged asymmetrically in the tube.

Preferably the base of the, or each, cup-shaped member lies in a plane which is normal to the axis of the tube, the base including a planar central region which, on deformation of the base, remains generally normal to the axis of the tube. This may be achieved by an arrangement in which the base of the, or each, cup-shaped member includes an annular depression circumscribing the planar central region of the base.

The cup-shaped members can be deep-drawn or pressed from steel plate. Typically, the tube is of steel and the cylindrical side wall of the, or each, cup-shaped member is welded internally to the wall of the tube at the edge of the side wall of the cup-shaped member. In all cases, it is preferred that the cup-shaped member is sufficiently deformable to be turned inside out by fluid under sufficiently high pressure.

The tube may include an externally projecting, internally threaded socket and the prestressing device may comprise a one-way valve having an externally threaded portion screwed into the socket. Conveniently, the one-way valve has a headed outer extremity adapted to engage with a connector of a high pressure pump and a pivoted flap serving a non-return function. According to a preferred feature of the device, a handle fixed externally to the tube extends over and protects the socket and the valve.

According to another aspect of the invention there is provided a mine prop comprising a prestressing device as summarised above and, for each cup-shaped member, a plunger having one end thereof inserted slidably into the tube so as to locate in the cup-shaped member, deformation of the base of the cup-shaped member by introduction of pressurised fluid serving to urge the plunger telescopically out of the tube.

Typically, the, or each, plunger comprises a length of timber of round cross-section press-fitted into the tube.

Another aspect of the invention provides a mine prop comprising a prestressing device as summarised above and first and second plungers having their ends thereof inserted slidably into the tube from opposite directions so as to locate in the first and second cup-shaped members, deformation of the bases of the cup-shaped members by introduction of pressurised fluid serving to urge the plungers telescopically and in opposite directions out of the tube. In this case, the preferred embodiment has plungers of timber, one of the plungers comprising a round cylindrical section inserted into the tube, a frusto-conical portion outside the tube, and a shoulder between the respective cylindrical and frusto-conical portions, and the other of the plungers being of round cylindrical shape throughout.

BRIEF DESCRIPTION OF THE DRAWINGS

The invention will now be described in more detail, by way of example only, with reference to the accompanying drawings.

In the drawings:

FIG. 5 shows a cross-sectional view of a third embodiment of the invention;

FIG. 6 shows a mine prop incorporating the device of FIG. 5;

FIG. 7 illustrates the embodiment of FIG. 5 after deformation of the prestressing device;

FIG. 8 shows a plan view of the prestressing device of FIG. 5;

DESCRIPTION OF PREFERRED EMBODIMENTS

Figure 1:
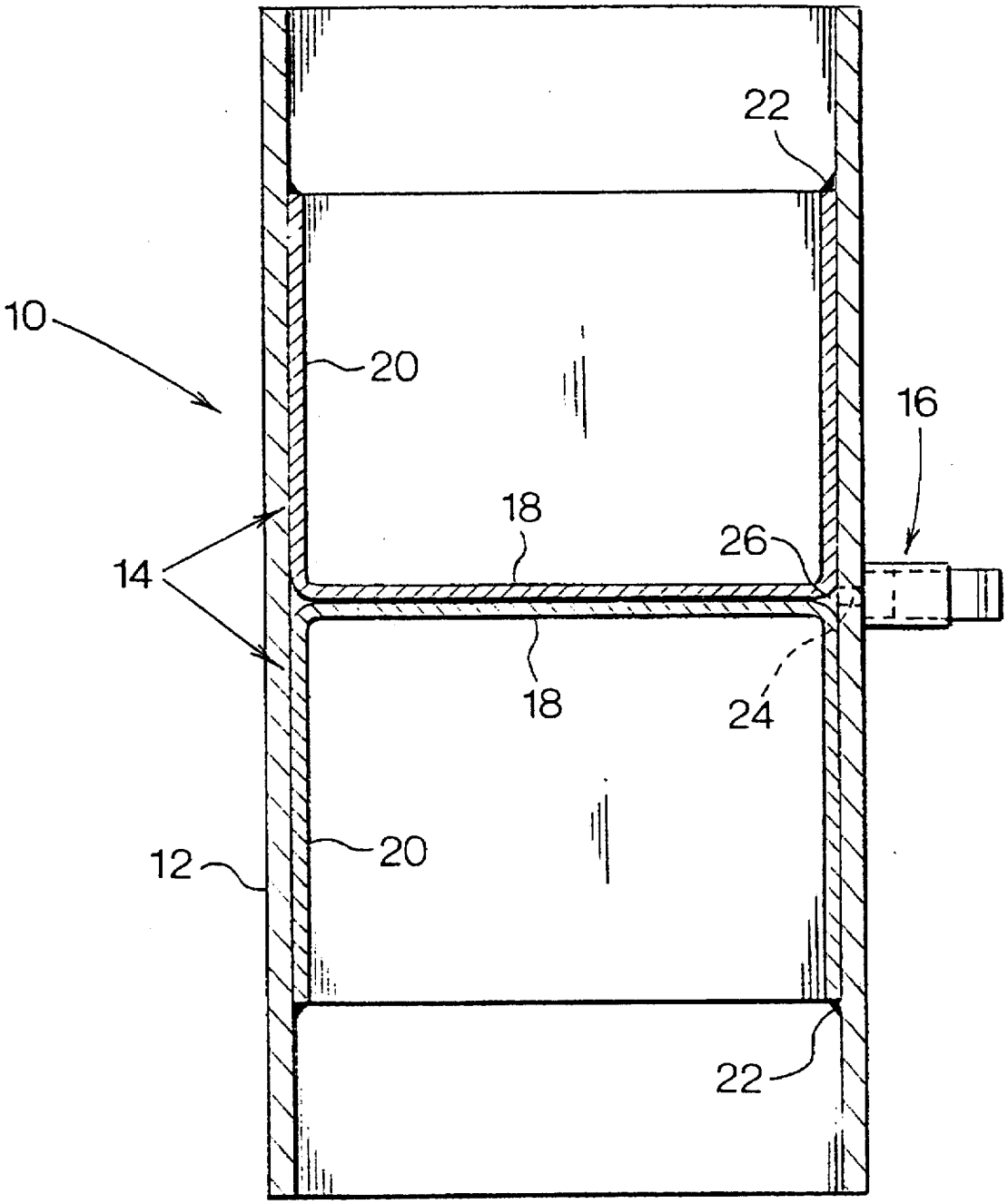
FIG. 1 shows an enlarged cross-sectional view of a mine prop prestressing device according to the invention.

The mine prop prestressing device 10 seen in FIG. 1 has four components, namely a steel tube 12, two identical cup-shaped members 14 and an inlet valve 16. Each of the cup-shaped members is deep drawn or pressed from thin gauge steel sheet and has a base 18 and a round cylindrical side wall 20 having an outside diameter slightly less than the internal diameter of the tube 12.

The members 14 are located in the tube 12 in opposition to one another, with their bases 18 in contact with one another and with their side walls 20 extending complementally along the internal surface of the wall of the tube 12, as illustrated in FIG. 1.

In practice, the wall thickness of the members 14 is sufficiently low for their bases 18 to be readily deformable. The extremities of the side walls 20 are welded at 22 to the wall of the tube. The inlet valve 16 is mounted in a socket on the tube 12 and serves an inlet 24 which extends through the wall of the tube to the gap 26 which is defined by the junctions of the bases and side walls of the members 14. The valve 16 is a one-way valve which allows fluid to flow into the tube 12 but not in the reverse direction. It is described below in more detail with reference to FIGS. 11 and 12.

Figure 2:
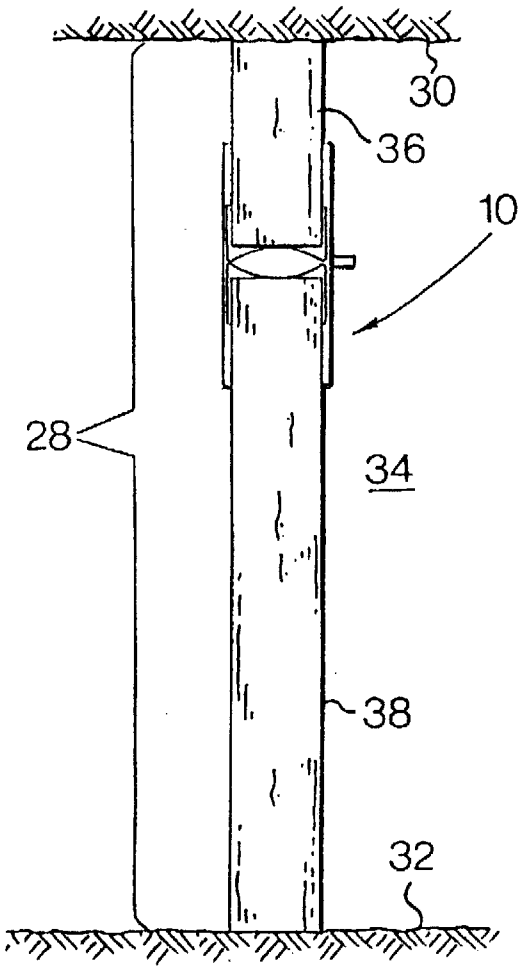
FIG. 2 illustrates a mine prop incorporating the device of FIG. 1.

FIG. 2 shows a mine prop 28 which is installed between the hanging wall 30 and the footwall 32 of a mine stope 34 and which incorporates the device 10. In addition to the device 10, the mine prop 28 includes two timber elements or plungers 36 and 38 of round cross-section. The timber plungers are typically lengths of Saligna which have been turned to a predetermined diameter slightly greater than the internal diameter of the tube 12 and which have been forced axially into the tube from either end, typically in a press. The inner ends of the plungers 36 and 38 locate in the members 14 as illustrated, with their inner extremities against the bases 18. The initial length of the prop 28 is slightly less than the width of the slope 34 so that, when the prop is arranged upright on the footwall 32, the upper end of the prop, i.e. the upper end of the plunger 36, is a short distance beneath the hanging wall.

With the prop installed upright as shown in FIG. 2, water or other hydraulic fluid is pumped under high pressure through the valve 16 into the tube 12. The water acts against the bases 18 of the members 14 and forces them apart from one another, with the result that the plungers 36 and 38 are driven in opposite directions out of the tube. The prop 28 therefore extends in length to bring the upper end of the plunger 36 into contact with the hanging wall 30. The water pressure is such that the prop 28 is placed under an initial preload of predetermined magnitude.

The preloaded prop is now in a condition to take loading imposed on it by the hanging wall. As the hanging wall closes towards the footwall with passage of time, either or both of the timber plungers deforms to accommodate the closure while the prop continues to support the load imposed on it by the hanging wall.

Figure 4:
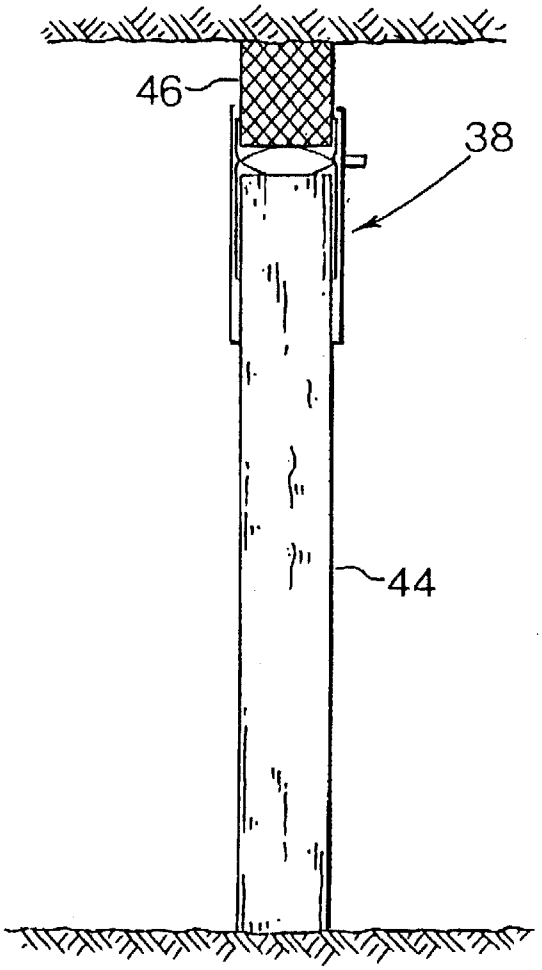
FIG. 4 illustrates a mine prop incorporating the device of FIG. 3.
Figure 3:
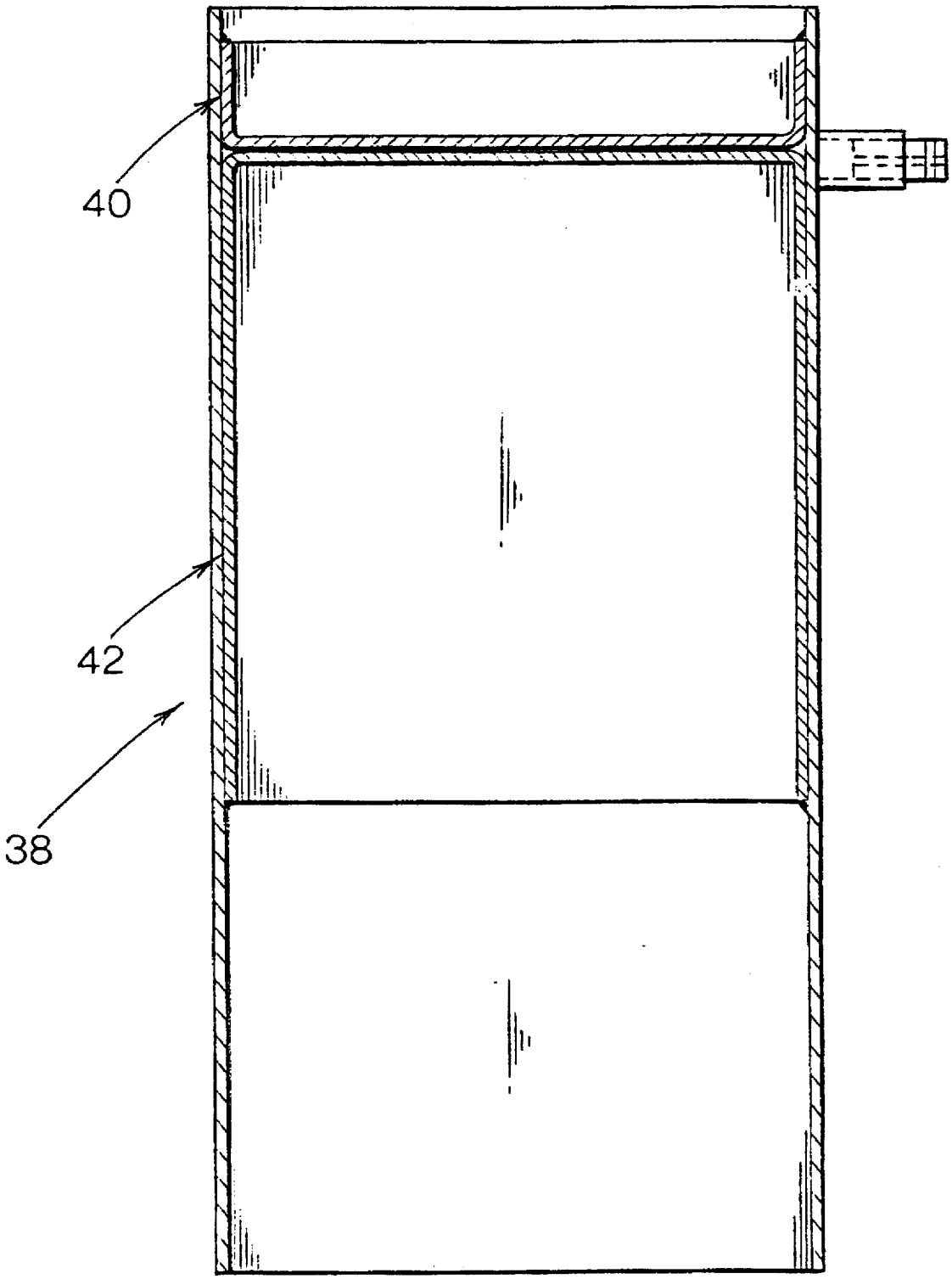
FIG. 3 shows an enlarged cross-sectional view of a mine prop prestressing device according to a second embodiment of the invention.

FIG. 3 illustrates another embodiment 38 of the invention in which the upper deep drawn member 40 is shallower than the lower member 42 but which is similar to the first embodiment in other respects. In the assembled mine prop of FIG. 4 a Saligna plunger 44 is inserted into the lower end of the device and an element 46 is inserted into the upper end. The element 46 is made of a material able to deform, on installation and setting of the prop, to take up the shape of the hanging wall, i.e. to take account of local irregularities in the shape of the hanging wall. Apart from this feature, the prop of FIG. 5 operates in much the same way as the prop 28 of FIG. 2, with closure of the hanging wall accommodated by deformation of the timber plunger 44.

A headboard could be fitted into the upper end of the device 28, 38 so as to provide a real coverage for the hanging wall.

FIGS. 5 and 7 illustrate a prestressing device according to a third embodiment of the invention before and after deformation of the cup-shaped members. As in the embodiment of FIG. 1, the prestressing device 50 of FIG. 5 has an outer steel tube 52, two identical cup-shaped members 54 and a valve 56. The cup-shaped members each have a base 58 and a round cylindrical side wall 60. The cup-shaped members are located in opposition to one another at a central position in the tube 52 and are welded to the tube at the edges of the side walls 60, as indicated by the numeral 62. The valve 56, which is described below in more detail, is screwed into a socket 64 projecting from the tube 52 and communicates with the interior of the tube between the bases 58 of the cup-shaped members 54.

An important difference between the embodiment of FIG. 5 and that of FIG. 1 is the shape of each base 58. Instead of being planar as in FIG. 1, each base 58 has a planar central region 66 and a circumscribing, annular channel-shaped depression 68, the outer extremity of which meets the side wall 60. In the result the central region 66 is slightly inwardly displaced relative to the extremity of the member 54 defined by the base of the depression 68.

The presence of the depression 68 affects the manner in which the bases 58 of the cup-shaped members deform when subjected to liquid pressure through the valve 56. In practice deformation is such that the planar central regions 66 move apart from one another in response to the internal pressure, while remaining generally parallel to one another. This is considered advantageous compared to the configuration of FIG. 1 because the generally parallel movement of the central regions 66 ensures that contact between the bases of the cup-shaped members and the timber elements, as described below, is maintained over a relatively large area rather than over a limited area as is the case if the bases of cup-shaped members merely bulge as in FIG. 2.

FIG. 7 illustrates the prestressing device 50 after internal pressurisation. It will be noted that the cup-shaped members have effectively inverted themselves, while remaining connected to the tube 52, with the central regions 66 still generally parallel to one another.

FIG. 6 illustrates a mine prop 70 incorporating the prestressing device 50, before pressurisation. The prop 70 includes, in addition to the prestressing device 50, an upper timber element 72 and a lower timber element 74. The upper element is shaped in the manner of a known PROFILE PROP with a conically shaped upper end 76, a shoulder 78 and a cylindrical portion 80 which is press-fitted into the upper end of the tube 12 so that the lower end of the portion 80 locates against the central region 66 of the upper cup-shaped member 54. The lower element 74 is cylindrical throughout and is circumscribed near its lower end by a reinforcing steel ring 82. The upper end of the element 74 is press-fitted into the lower end of the tube 12 so as to located against the central region 66 of the lower cup-shaped member 54. Nails 84 are driven through holes in the tube 12 into the timber elements 72 and 74 to ensure that the elements are retained firmly in their inserted positions in the tube 12.

EXAMPLE

In a practical example employing a prestressing device of the type seen in FIG. 5, timber elements 72 and 74 turned to a nominal diameter of approximately 210 mm were press-fitted into a tube 52 of 209 mm internal diameter. The tube had a wall thickness of 4.5 mm and an overall length of 300 mm. The cup-shaped members 54 had a matching outside diameter and were pressed from 1.6 mm steel plate. The overall depth of each cup-shaped member, i.e. the dimension 86 in FIG. 5, was 40 mm. The inward displacement of the central planar region 66 was approximately 3 mm. The steel ring 82 was formed of 5 mm diameter mild steel wire nailed to the lower timber element 74. The timber elements were of the Saligna variety. The overall length of the prop was 1.2 m.

Figure 9:
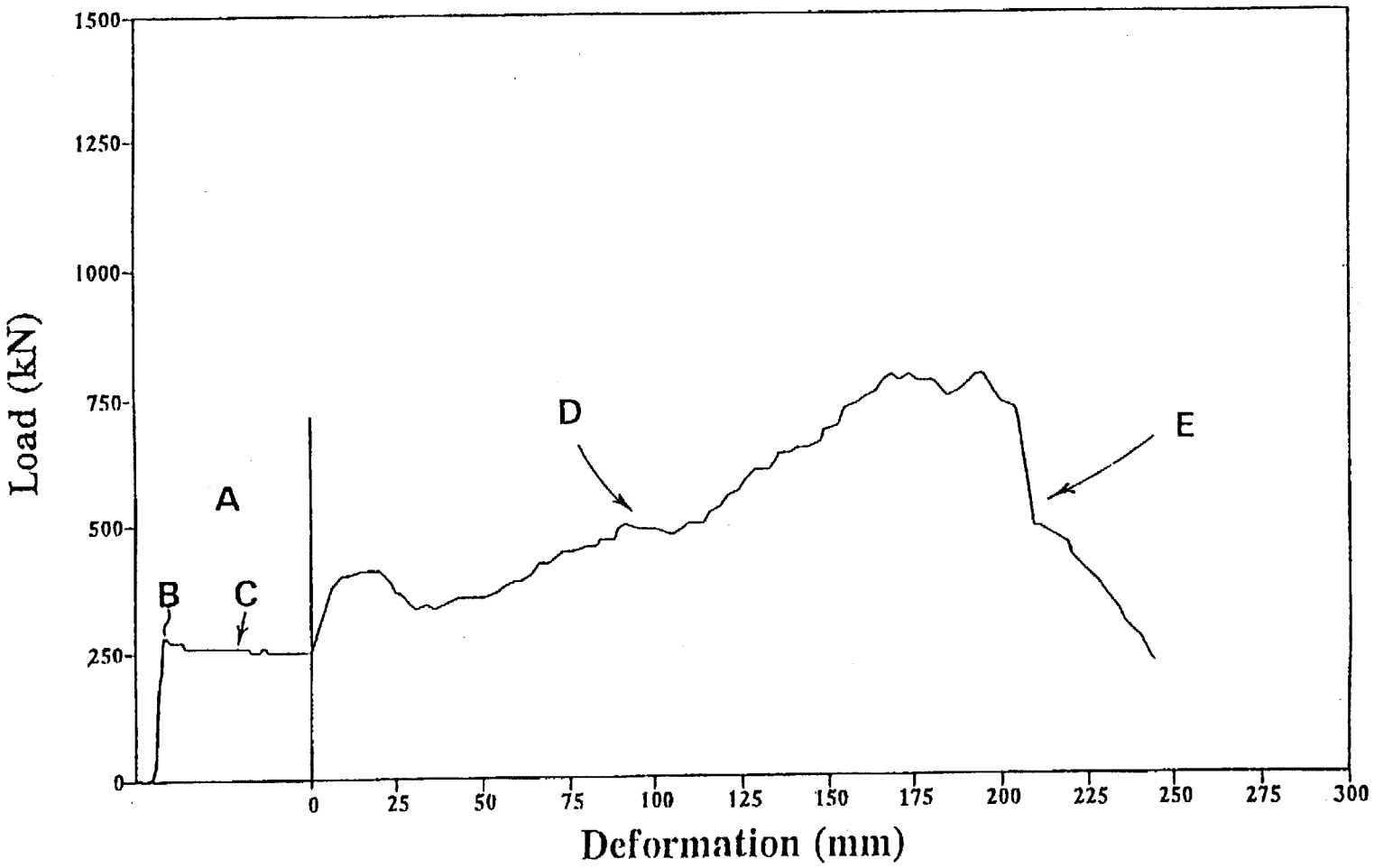
FIG. 9 is a graph illustrating the performance of the prop of FIG. 6.

FIG. 9 illustrates the performance of the prop described above in a press. The region marked "A" in the graph relates to the initial setting and preloading of the prop. At the commencement of the test, the lower end of the prop was placed on a bottom platen of the press with the upper end of the prop approximately 35 mm below the upper platen. The interior of the tube 12 was pressurised with water. This was achieved by connecting a high pressure, pneumatically operated pump to the valve 56, described below in more detail. The internal pressurisation of the tube 12 deformed the bases 58 apart from one another to the condition seen in FIG. 7. The deformation of the bases increased the overall length of the prop 70 and brought the upper end of the upper timber element 72 into contact with the upper platen. Internal pressurisation was sufficient to impose a preload force of approximately 27 tons (270 kN) on the prop, as indicated by the point "B" in FIG. 9. Thereafter the load decreased slightly with passage of time, as indicated by the numeral "C" in FIG. 9, as a result of timber creep.

After initial preloading as described above, the press was operated at a constant closure rate of 30 mm per minute. The performance of the prop under the imposed loading is indicated in FIG. 9 by the numeral "D". It will be seen that the prop continually accepted load up to a maximum level of approximately 75 tons (750 kN), at a closure of approximately 200 mm, whereafter there was rapid load shedding, in the region "E" of the graph, as the timber failed in compression.

Referring again to FIGS. 5 and 7, it is believed that the dimension 86 should not exceed a value of about 60 mm for cup-shaped members having a thickness of about 1.6 mm. In practice, when the tube is pressurised through the valve 56, water pressure acts between the wall of the tube 12 and the side walls 60 of the cup-shaped members and forces the side walls inwardly. The side walls 60 are pressed against and clamp the ends of the timber elements during initial pressurisation and before inversion of the cup-shaped members, and this reduces the ease with which the timber elements can be driven out of the tube as the bases 58 of the cup-shaped members move apart from one another.

In order to give a sufficient range of prop extension during preloading, it is expected that the dimension 86 will normally not be less than about 30 mm.

Figure 10:
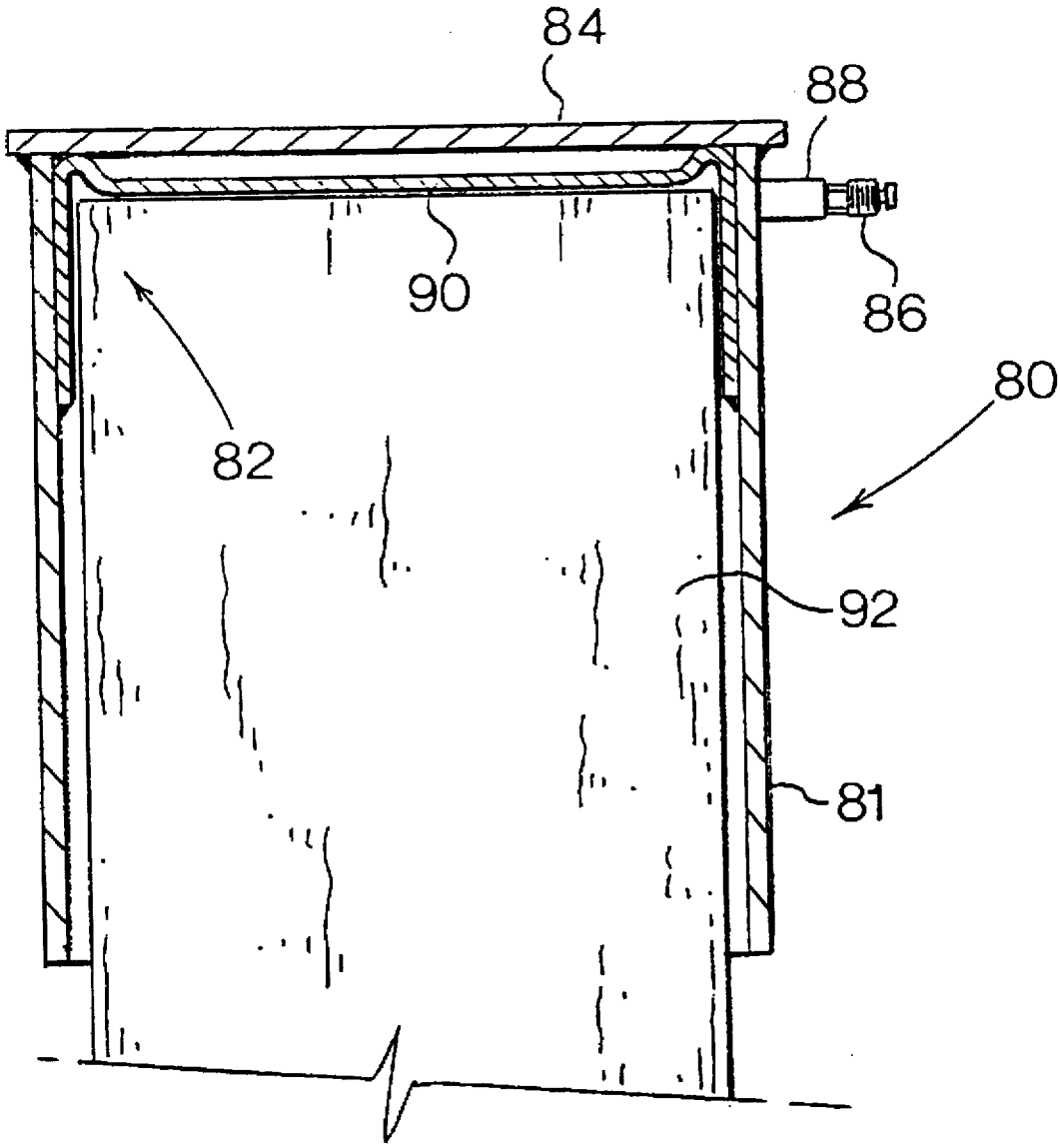
FIG. 10 shows a cross-sectional view of a fourth embodiment of the invention.

FIG. 10 illustrates a fourth embodiment of prestressing device 80 in which there is only one cup-shaped member 82. The upper end of the tube 12 is closed by a circular plate 84 and the cup-shaped member 82, similar in all respects to the cup-shaped members 54 of FIG. 5, is welded in position in the tube adjacent the plate. A valve 86, similar to the valve 56, is screwed into a socket 88 in the side wall of the tube 81.

In operation of the embodiment of FIG. 10, internal pressurisation of the tube through the valve 86 drives the base of the cup-shaped member away from the plate 84 with the central region 90 of the base remaining generally parallel to the plate. A timber element 92 press-fitted into the lower end of the tube is driven out of the tube to extend the prop. The plate 84 may also deform during pressurisation, depending on its thickness.

In FIG. 10 it will be appreciated that the plate 84 will bear directly on the hanging wall of the mine working although it would of course be possible to provide a transverse headboard on the plate which would contact the hanging wall and provide a real coverage. It will also be appreciated that with a single cup-shaped member, the range of prop extension on installation will be reduced compared to the earlier embodiments employing two cup-shaped members in opposition to one another.

Figure 11:
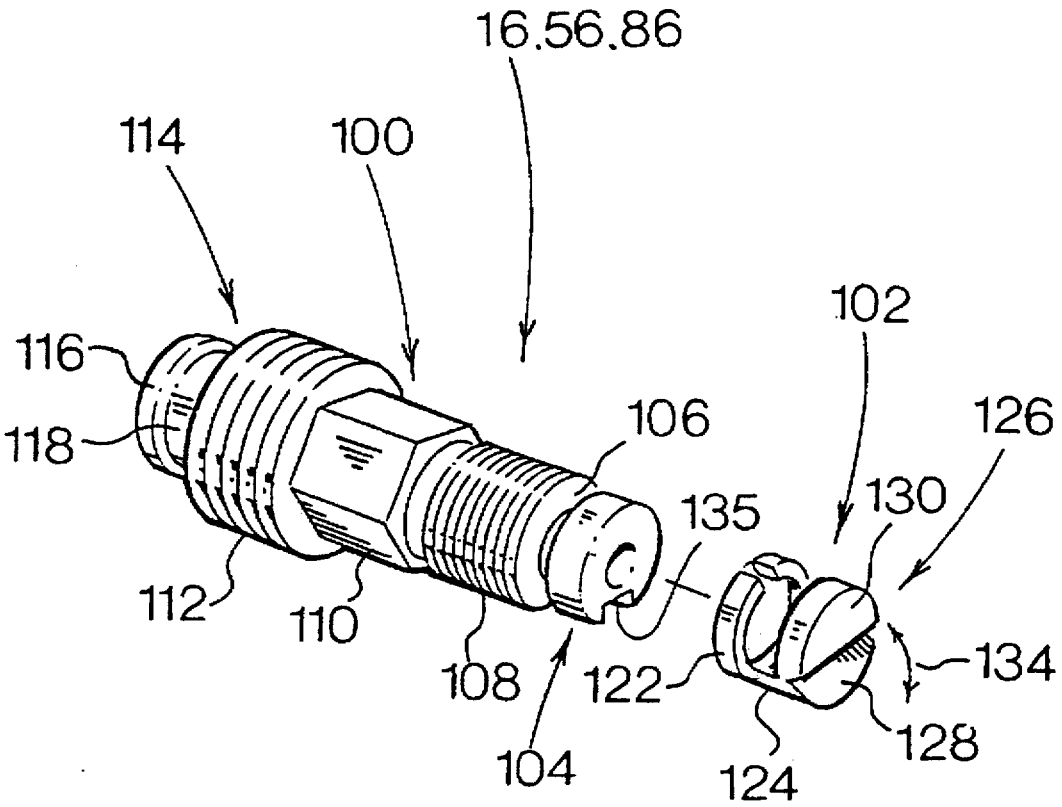
FIG. 11 shows an exploded perspective view of the charging valve.
Figure 12:
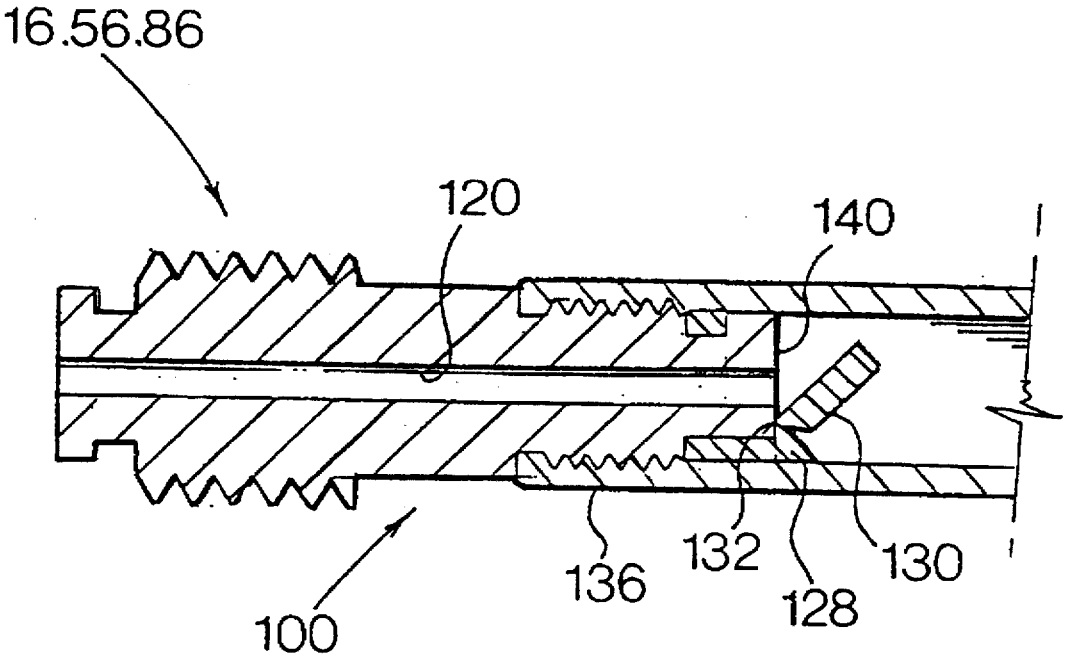
FIG. 12 shows a cross-sectional view of the valve in an assembled and installed condition.

Reference is now made to FIGS. 11 and 12 which illustrate the valve 16, 56, 86 used in the embodiments described above. The valve has a unitary valve body 100 of glass-reinforced nylon, and a flap closure 102. The valve body has an inner end 104 formed with an annular groove 106, a portion 108 formed with an external thread of small pitch, a portion 110 which is hexagonal in cross-section, and an outer end portion 114 consisting of a head 116 and an annular groove 118. A passage 120 extends through the valve body 100 from one end to the other.

The flap closure 102 is made of a resilient grade of plastics material, typically nylon, and has a split ring 122 which can be prised open and located in the annular groove 106 at the inner end of the valve body 100. Attached to the ring 122 by an integral filament 124 is a flap 126 having a base section 128 and a planar closure section 130 which is joined to the base section 128 by a thin web 132. The thinness of the web 132 allows the section 130 to pivot relative to the base section 128 as indicated by the arrow 134. When the flap closure is mounted on the valve body with the ring 122 located in the groove 106, the filament 124 locates in a notch 135 in the end 104.

The threaded portion 108 of the valve body is threaded tightly and in sealing fashion into an internally threaded socket 136 carried by the wall of the tube 12. Tight engagement is facilitated by the hexagonal section portion 110 which can be gripped with a spanner or like tool.

When the tube is to be internally pressurised the high pressure connector of the high pressure pump or pressure intensifier is then engaged with the outer end portion 114 of the valve body. The high pressure connector is typically of a known type having an undercut flange which can be slid, by relative transverse movement between the connector and the portion 114, into the groove 118 so as to engage behind the head 116. After high pressure pumping has been completed, the high pressure pump connector is detached from the portion 114 by slipping it in the opposition direction.

During pumping the water causes the closure section 130 of the flap closure 102 to pivot to an open position to admit the water into the tube 12. After pumping the internal pressure of the water pivots the section 130 to a closed position in which it seats on the inner end face 140 of the valve body and prevents loss of internal pressure.

The illustrated valve is of simple and economical construction. An advantage of the illustrated construction arises from the fact that even if the projecting portions of the valve body are inadvertently broken off, for instance by a hard, transverse impact or by blasting at the mining face, the flap closure 102 is protected and will remain in its seated position to prevent pressure loss. This is considered to be advantageous compared to more sophisticated one-way valve designs which incorporate internal spring loaded valve closures and in which the internal sealing components may be destroyed or fly free in the event of exposed portions of the valve being damaged by a blow or by the effects of blasting at the face.

Referring again to FIGS. 11 and 12, it will be seen that the valve body also includes a portion 112 which is formed with an external thread of greater pitch than the portion 108. The portion 112 may be engaged by a threaded connector in situations where a settable grout is used to pressurise the tube instead of water. The threaded connector will typically be carried at the end of a hose extending from a grout pump. The threaded portion 112 also provides the facility for a two-stage pressurisation in which grout is first pumped into the tube under relatively low pressure and water is then pumped into the tube under relatively high pressure. In cases where pressurisation is by water only, the threaded portion 112 may be omitted.

As illustrated by FIG. 8, the tube 12 may have a carrying handle 150 welded to it over the valve. This protects the valve against breakage should the prop fall over. It also provides protection for the valve if the prop is rolled over the ground or footwall prior to installation. A handle of the illustrated type can be provided on the tube of any of the embodiments described above.

In each of the embodiments described above, the tube 12 may also be provided with hooks or other suspension points by means of which blast barricades can be suspended from the prop.

During pressurisation of the tube in each embodiment, and before the prop is extended into contact with both the footwall and the hanging wall, the upper end of the prop may be lightly wedged in place to prevent the prop from toppling over. This can be achieved in practice simply by wedging a rock or the like between the upper end of the prop and the hanging wall. The rock will then be ejected sideways as preload is applied or will be crushed.

It will be appreciated that many modifications may be made within the scope of the invention. For instance, in the embodiment of FIGS. 5 and 10, a circumscribing, channel-shaped depression is provided about the central region of the base. The depression assists in causing the central region of the base to move, when the base is deformed, so as to remain normal to the axis of the tube. However in other embodiments, this objective may be achieved in other ways, possibly by weakening the periphery of the base so to induce preferential deformation at that location.

I claim:

1. A mine prop prestressing device comprising a tube, a flexible cup-shaped member inside the tube, said cup-shaped member having a base and a cylindrical side wall permanently fixed internally to the wall of the tube, a counter-member which is fixed to the tube and which spans across the tube in opposition to and adjacent the base of the cup-shaped member, and a valved inlet leading through the wall of the tube for the purpose of introducing a pressurised fluid into the tube between the base of the cup-shaped member and the counter-member so as to deform the base of the cup-shaped member and the counter member apart from one another.

2. A mine prop prestressing device according to claim 1 wherein the base of the cup-shaped member is arranged to deform away from the counter-member when a fluid at sufficiently high pressure is introduced into the tube through the valved inlet.

3. A mine prop prestressing device according to claim 2 wherein the counter-member is in the form of a plate spanning across the tube.

4. A mine prop prestressing device according to claim 2 wherein the counter-member is in the form of a second cup-shaped member having a base and a cylindrical side wall fixed internally to the wall of the tube, the second cup-shaped member being arranged in opposition to the first cup-shaped member with the bases of the cup-shaped members adjacent to one another and with the cylindrical side walls of the cup-shaped members extending in opposite directions from their respective bases.

5. A mine prop prestressing device according to claim 4 wherein the second cup-shaped member is identical to the first cup-shaped member.

6. A mine prop prestressing device according to claim 5 wherein the first and second cup-shaped members are arranged symmetrically about a central transverse plane bisecting the tube.

7. A mine prop prestressing device according to claim 4 wherein the cylindrical side walls of the first and second cup-shaped members are of different length.

8. A mine prop prestressing device according to claim 7 wherein the first and second cup-shaped members are arranged asymmetrically in the tube.

9. A mine prop comprising a prestressing device according to claim 4 and first and second plungers having their ends thereof inserted slidably into the tube from opposite directions so as to locate in the first and second cup-shaped members, deformation of the bases of the cup-shaped members by introduction of pressurised fitted serving to urge the plungers telescopically and in opposite directions out of the tube.

10. A mine prop according to claim 9 wherein both plungers are of timber and wherein one of the plungers comprises a round cylindrical section inserted into the tube, a frusto-conical portion outside the tube, and a shoulder between the respective cylindrical and frusto-conical portions, and the other of the plungers being of round cylindrical shape throughout.

11. A mine prop prestressing device according to claim 2 wherein the base of the cup-shaped member lies in a plane which is normal to the axis of the tube, the base including a planar central region which, on deformation of the base, remains generally normal to the axis of the tube.

12. A mine prop prestressing device according to claim 11 wherein the base of the cup-shaped member includes an annular depression circumscribing the planar central region of the base.

13. A mine prop prestressing device according to claim 2 wherein the cup-shaped member is deep-drawn or pressed from steel plate.

14. A mine prop prestressing device according to claim 2 wherein the tube is of steel and the cylindrical side wall of the cup-shaped member is welded internally to the wall of the tube at the edge of the side wall of the cup-shaped member.

15. A mine prop prestressing device according to claim 14 wherein the cup-shaped member is sufficiently deformable to be turned inside out by fluid under sufficiently high pressure.

16. A mine prop comprising a prestressing device according to claim 2 and a plunger having one end thereof inserted slidably into the tube so as to locate in the cup-shaped member, deformation of the base of the cup-shaped member by introduction of pressurised fluid serving to urge the plunger telescopically out of the tube.

17. A mine prop according to claim 16 wherein the plunger comprises a length of timber of round cross-section press-fitted into the tube.

18. A mine prop prestressing device according to claim 1 wherein the tube has an externally projecting, internally threaded socket and the prestressing device comprises a one-way valve having an externally threaded portion screwed into the socket.

19. A mine prop prestressing device according to claim 18 wherein the one-way valve has a headed outer extremity adapted to engage with a connector of a high pressure pump.

20. A mine prop prestressing device according to claim 18 wherein the one-way valve includes a pivoted flap serving a non-return function.

21. A mine prop prestressing device according to claim 18 comprising a handle fixed externally to the tube, the handle extending over and protecting the socket and the valve.

* * * * *